United States Patent [19]

Brown, Jr. et al.

[11] Patent Number: 4,751,994

[45] Date of Patent: Jun. 21, 1988

[54] COIN CONTROLLED COMPRESSED AIR-ACTUATED ATOMIZER

[75] Inventors: Ray W. Brown, Jr., Memphis; Charles C. King, III, Germantown, both of Tenn.

[73] Assignee: K-Sun Company, Inc., Memphis, Tenn.

[21] Appl. No.: 925,214

[22] Filed: Oct. 31, 1986

[51] Int. Cl.[4] ..... G07F 15/04

[52] U.S. Cl. ..... 194/341; 222/136; 239/308; 239/331; 239/414

[58] Field of Search ..... 194/339, 341; 222/2, 222/134, 136, 334; 239/304, 307, 308, 331, 332, 414, 415

[56] References Cited

U.S. PATENT DOCUMENTS 668,535 2/1901 Mesnage ..... 194/339

2,688,514 9/1954 Oishei et al. ..... 239/331 X 4,171,039 10/1979 Ingham ..... 194/242

4,197,994 4/1980 Liedberg ..... 239/414 X 4,611,732 9/1986 King ..... 222/639

*Primary Examiner*—F. J. Bartuska

*Attorney, Agent, or Firm*—Nies, Webner, Kurz & Bergert

[57] ABSTRACT

A coin-controlled atomizer dispensing system is actuated entirely by compressed air or gas. At the conclusion of an operating cycle a cylinder is charged with liquid to be dispensed. The next operating cycle is initiated by inserting a coin which momentarily opens an air valve. A charge of compressed air and a charge of liquid are simultaneously fed to an atomizer nozzle until the charge of liquid in the cylinder has been completely dispensed whereupon the compressed air is cut off and the cycle is terminated by re-charging the cylinder with the next charge of liquid to be dispensed.

5 Claims, 2 Drawing Sheets

COIN CONTROLLED COMPRESSED AIR-ACTUATED ATOMIZER

BACKGROUND AND OBJECTS

Suntan lotion dispensers, such as the subject one, have certain idiosyncracies which must be satisfied. First of all, they are generally located near a swimming pool or a beach or golf course where electric power to operate them is generally unavailable or if available, undesirable. The customer may have wet feet and hands, and even when the dispenser is well grounded and provided with ground-fault detection, domestic electric power is undesirable. The low-voltage, low-current battery power may be used, the location of the machine often times makes it subject to drenching rains or flying sands so that switch fouling or corrosion is likely and besides, coin operated electrically controlled operating circuits are notoriously easy to "gyp". The primary object of this invention is to avoid hazards of these ilk by providing an entirely self-sustaining coin operated dispenser whose sole source of power is compressed gas, i.e., air or $CO_2$.

A further object of the invention is to provide an atomizing dispenser for suntan lotion which has an operating cycle during which a single measured charge of liquid is dispensed, and which can not be stopped in mid-cycle and drain out more than one measured charge, thereby defeating the ingenious, who, with wires, toothpicks and electro-magnets have been known to "milk out" the entire contents of a vending machine, sometimes without investment of a single coin.

These and other objects will be apparent from the following specification and drawings in which FIG. 1 is a diagram of one embodiment of the invention at the start of an operating cycle;

Figure 1:
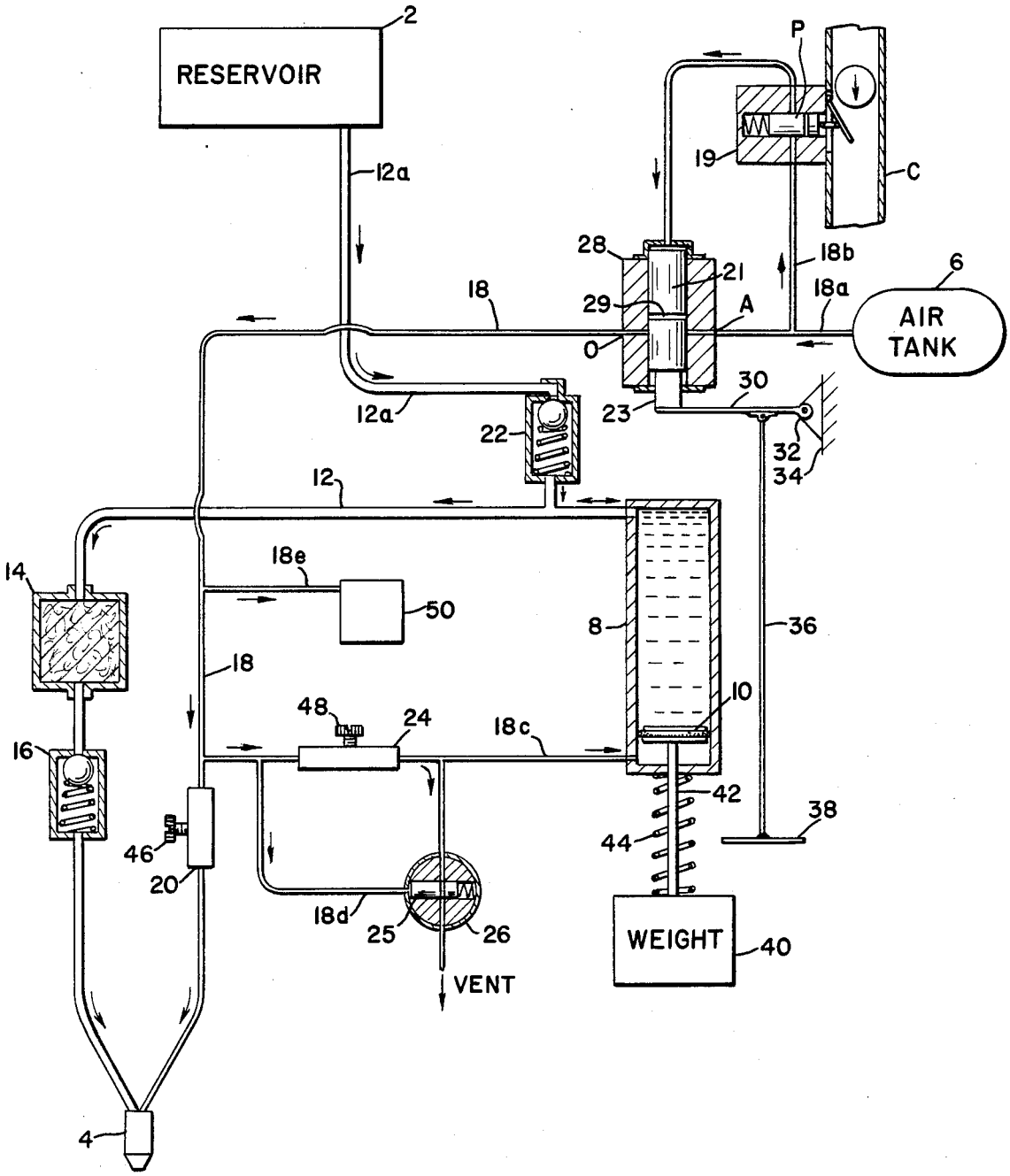

In the FIG. 1 system the liquid to be dispensed, for example suntan oil, is supplied from a reservoir 2 to an atomizer 4 from which a fine spray is propelled by compressed air or gas from a tank 6. A charge of oil is trapped in cylinder 8 and forced therefrom by a piston 10, travelling by oil line 12 through a filter 14 and normally closed check valve 16 to the atomizer nozzle. The charge of oil is gravity fed to cylinder 8 via an oil line 12*a* leading from tank 2 to cylinder 8 through a normally closed check valve 22. It will be understood that the check valves 22 and 16 permit oil to flow in the direction of the arrows and that they block flow in the opposite direction; and that the check valve, for example, spraying-loaded ball checks, in their normally closed conditions impede the oil flow therethrough sufficiently to prevent dribbling of the oil through oil line 12 to the atomizer nozzle 4.

Compressed air is fed via an air line 18*a* and 18*b* to a normally closed coined controlled valve 19; and when the coin-controlled valve 19 is momentarily opened by insertion of a coin into chute C, compressed air from line 18*b* flows therethrough to a controlled element 21 of a valve 28 so as to bring annular groove 29 into register with ports A and O and thereby to open the valve and when the valve opens air flows under pressure via air line 18 and a manually adjustable needle valve 20 to the atomizer nozzle 4. In addition, air flows from line 18 through a manually adjustable needle valve 24 and line 18*c* to the trap cylinder 8 on the other side of its piston 10 so as to force the piston upwardly. When the system is at rest, prior to an operating cycle, the air lines 18 and 18*c* are vented to the atmosphere by means of a normally open vent valve; but when valve 28 is open, pressurized air flows to a control element 25 of the normally open vent valve 26 so as to close them and thereby permit compressed air to flow to cylinder 8 and force piston 10 upwardly and force out the charge of oil in cylinder 8 on the upper side of piston 10.

Piston valve 28 has a plunger 23 which is engaged by a re-set lever 30 which is pivoted as at 32 to a suitable support 34 connected to lever 30 is a push rod 36 on the lower end of which is an abutment plate 38 engagable by a weight 40 on the piston rod 42. If desired the weight 40 may be assisted by a compression spring 44, the operation here being that when compressed air forces the piston up so as to discharge the charge of oil in cylinder 8, weight 40 engages plate 38 so as to force push rod 36 up and pivot lever 30 upwardly so as to force the plunger 23 of valve 28 upwardly to close parts A and O valve 28.

When the system is at rest and prior to an operating cycle, the annular groove 25 of valve 28 is closed, the piston 10 of cylinder 8 is down under the influence of weight 40 and spring 44, vent valve 26 is open and the check valve 16 and 22 are closed. Upon momentary opening of the coin-operated valve 19 caused by insertion of a coin and push on the plunger, a charge of air feeds therethrough to the piston 21 of valve 28 and the latter opens and permits a charge of air to flow via line 18 through needle valve 20 and thence to atomizer nozzle 4; and additional air flows through branch line 18*d* to close the normally open vent valve 26 and additional air flows through needle valve 24 and line 18*c* to the underside of piston 10, forcing the latter upwardly and thereby forcing the charge of oil trapped in cylinder 18 via line 12 and filters 14 and check valve 16 to atomizer 4.

Needle valves 20 and 24 can be adjusted through their control elements 46 and 48 so as to provide the necessary back pressures in air line 18. Upon completion of an operating cycle, when weight 40 has engaged plate 38 so as to pivot lever 30 upwardly and actuate the valve plunger 23 to close valve 28, the pressure of air in air line 18*d* drops and vent valve 26 opens, thereby permitting weight 40 to pull piston 10 down and suck into cylinder 8 the oil from reservoir 2 via check valve 22. Check valve 22 prevents the oil forced from cylinder 8 from backing up into reservoir 2 and check valve 16 prevents oil from atomizer nozzle 4 from backing up through oil line 12 from the atomizer nozzle.

Each time air line 18 is charged with pressurized air, a charge flows through air line branch 18*e* so as to actuate a counter 50.

Figure 2:
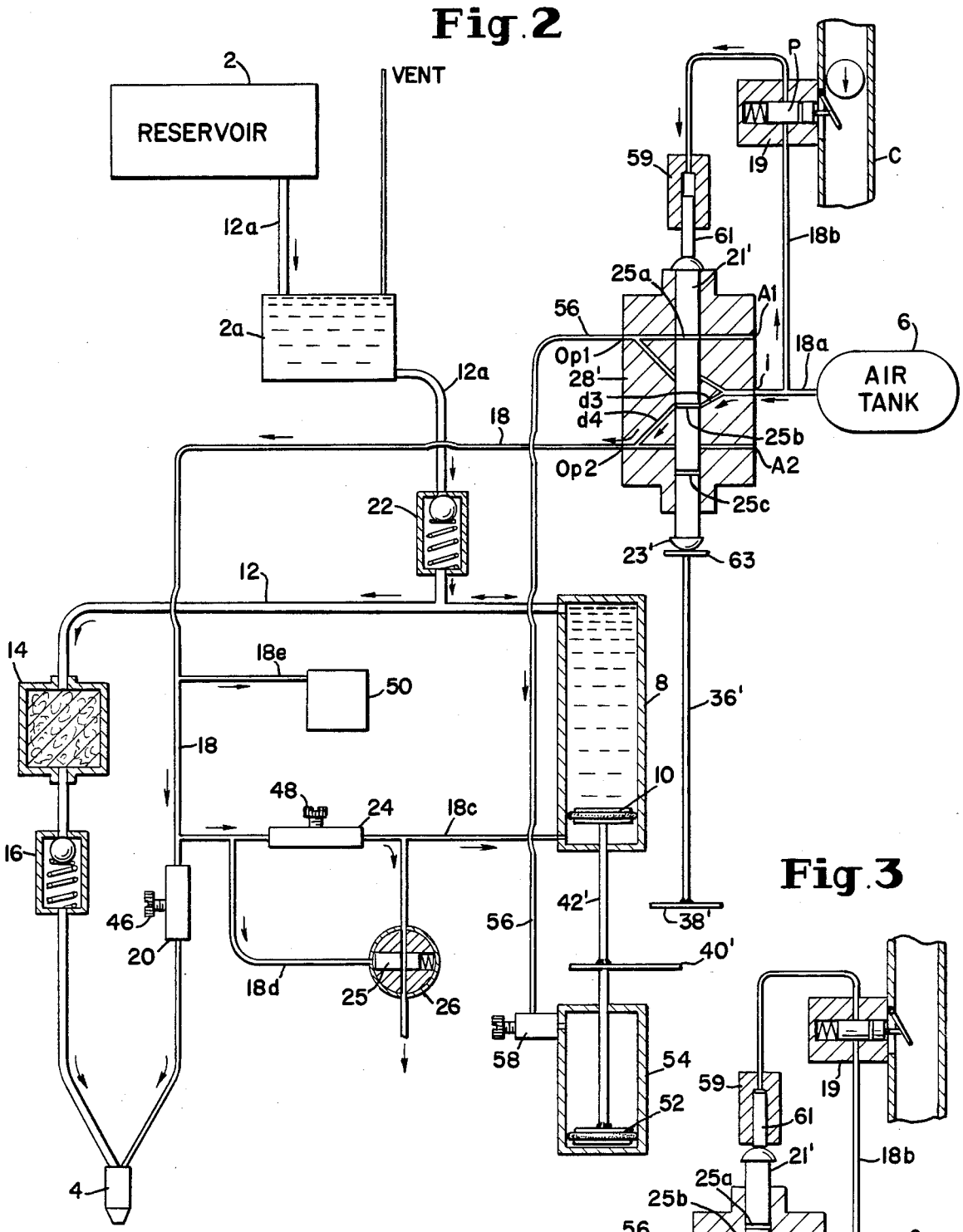
FIG. 2 is a diagram of a second embodiment of the invention.
Figure 3:
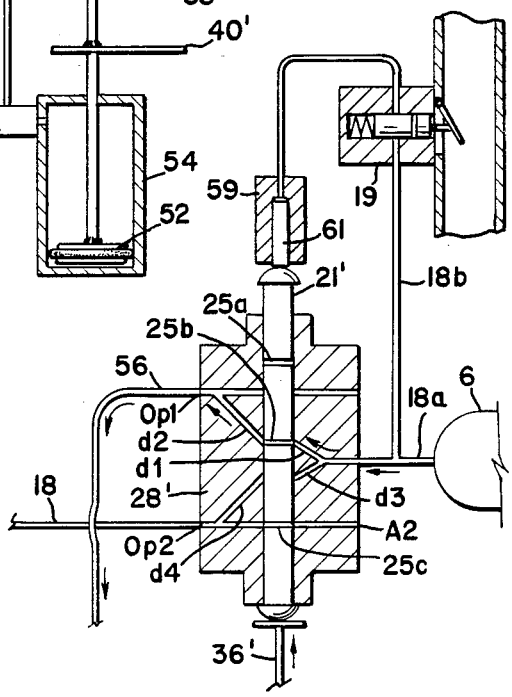
FIG. 3 is a diagram of the control valve for the FIG. 2 system during re-charging of the system.

The system shown in FIGS. 2 and 3 is the same as that of FIG. 1 except for the actuation of the double-acting valve 28'. In FIG. 2 the elements which are the same as those previously described are designated with the same numbers and the elements corresponding to but not the same as those previously described are designated with prime reference numerals. In the FIG. 2 embodiment, there is a sightglass 2*a* to show that the reservoir contains oil to be dispensed. Also the piston rod 42' for piston 10 is connected to a piston 52 in cylinder 54. Instead of being weight or spring actuated, piston rod 42' is driven downwardly by the pressure of air in line 56 on the upper side of piston 52 in cylinder 54. Valve 28' is a switch valve in which air under pressure in line 18*a* is directed either to the air line 18 which serves the same functions as the air line 18 in the FIG. 1 system or to air line 56 which feeds compressed air into cylinder 54 on the upper side of piston 52. A needle valve 58 is used to control the rate of flow of air to cylinder 54.

The piston 21' of switch valve 28' has three annular grooves 25*a*, 25*b* and 25*c*. It has one inlet port i which is connected by air line 18*a* to compressed air tank 6, to outlet ports op1 and op2. Port op1 is connected by an air line 56 to the upper part of cylinder 54 (above piston 52) and the outlet port op2 is connected by air line 18 to atomizer 4 and also to the lower part of cylinder 8 (below piston 10). The system in the FIG. 2 condition is feeding compressed air to line 18. It is fed from inlet port i, a duct d3, annular groove 25*b*, a duct d4 and outlet port op2. In the FIG. 3 condition duct d4 is blinded and duct d2, which was blinded in the FIG. 2 condition is now open. Valve 28' also has two other ports A1 and A2, both leading to the atmosphere.

When the FIG. 2 is at rest, its piston 21' is in its "up" position (FIG. 3) but when a coin is inserted in the coin controlled valve 19 a charge of compressed air is fed to the top of a cylinder 59, driving plunger 61 down to its FIG. 1 position, thereby instituting a dispensing cycle. In this condition line 56 leading from the upper portion cylinder 54 is vented to the atmosphere via op1, groove 25*a*, and port A1 so that piston 52 in cylinder 54 can rise with piston 10 in cylinder 8. However, when piston 52 approaches its upper limit, plate 40' is driven upwardly until a plate 63 on the upper end of rod 36' engages the lower end 23' of cylinder 21' thereby returning the valve to its end of cycle (FIG. 2) position in which compressed air is fed via inlet port i, duct d1, groove 25*b* and duct d2 and outlet port op1 to line 56, thereby driving piston 52 in cylinder 54 and piston 10 in cylinder 8 downwardly. When piston 10 moves downwardly it sucks in a charge of liquid from the reservoir from the system and the system is ready to commence a new cycle.

At the outset of an operating cycle, when a coin is inserted in coin-controlled valve 19, air is fed to plunger 61, pushing the control element 21' of valve 28', thereby switching valve 28' to feed air into the air line 18 while simultaneously cutting off the air in air line 56 which leads to the top of cylinder 54. As in the FIG. 1 embodiment, when air line 18 is pressurized, air is fed to the underside of piston 10 forcing it upwardly to discharge the oil trapped in cylinder 8 above piston 10 until a plate 40' on piston rod 42' engages plate 38' on push rod 36' forcing the latter upwardly to operate the control element 23' on valve 28', thereby cutting off the supply of air to line 18 and opening the supply of air to line 56, thereby driving piston 52 downwardly so that it pulls down with it the piston 10 in valve 8 so as to draw in another charge of oil through check valve 22.

We claim:

1. A compressed air actuated atomizer for dispensing a charge of liquid, comprising;

a source of compressed air, a reservoir for liquid to be dispensed, an atomizer nozzle, a cylinder having a piston movable between extended and retracted positions, said piston having opposite sides, fluid connection means between cylinder on one side of the piston, the reservoir and the nozzle whereby upon movement of the piston from its extended position to its retracted position liquid is drawn from the reservoir into the cylinder and upon movement of the piston from its retracted positon to its extended position the entrapped liquid is forced from the cylinder to the nozzle, fluid conduit means between the source of compressed air and the nozzle and the cylinder on the other side of the piston, control valve, means providing a normally closed passage in said fluid conduit means.

coin-controlled valve means for momentarily opening said control valve means upon insertion of a coin therein whereby compressed air from said source applies force to the other side of said piston whereby to force said piston from its retracted position to its extended position, means responsive to movement of said piston from its retracted position to its extended position for closing said control valve means, means for returning said piston from its extended to its retracted position upon closure of said control valve means, normally open vent passage means for venting the fluid conduit means and the cylinder on the other side of the piston to the atmosphere, a normally open pressure-responsive valve means in said vent passage means, said pressure-responsive valve means including a control means connected to said fluid conduit means at a location therein between the control valve means and said cylinder on the other side of said piston whereby to close said vent passage means in response to fluid pressure in said fluid conduit means and thereby close said vent passage means when said control valve means is opened.

2. The combination claimed in claim 1, and check valve means of said fluid connections for blocking flow of the liquid in directions from the cylinder and the nozzle towards the reservoir.

3. In the combination claimed in claim 1, a normally closed bleeder valve means in a connection between the fluid conduit means and the atmosphere, said bleeder valve means being responsive to pressure of air in said fluid conduit means whereby to close the connection to the atmosphere in response to pressure of air in the fluid control valve means, whereby relieving the pressure of air in the cylinder on the other side of the pistoin so as to permit the piston to return from its extended to its retracted position.

4. The combination claimed in claim 1, the means for returning said piston from its extended position to its retracted position including compression spring means operatively engaged between the cylinder and piston, said compression spring means being compressed upon movement of said piston from its retracted position to its extended position.

5. The combination claimed in claimed 1, the means for returning said piston from its extended to its retracted position including another cylinder, another piston connected to the first-named piston for movement therewith between extended and retracted positions, said other piston having opposite sides wherein compressed air fed to the other cylinder on one side of said other piston forces said other piston from an extended to a retracted position, another fluid conduit means running from said other cylinder on said one side of said other piston through another passage in said control valve means to said source of compressed air, said control valve means normally opening said other passage upon closure of the first-named passage.

* * * * *